United States Patent [19]

Richardson

[11] Patent Number: 4,886,445

[45] Date of Patent: Dec. 12, 1989

[54] GAS BURNING ARTIFICIAL LOG ASSEMBLY

[75] Inventor: Stephen F. Richardson, Randolph Center, Vt.

[73] Assignee: Vermont Castings, Inc., Randolph, Vt.

[21] Appl. No.: 115,887

[22] Filed: Nov. 2, 1987

[51] Int. Cl.[4] ..... F23Q 2/32

[52] U.S. Cl. ..... 431/125; 126/298; 126/512

[58] Field of Search ..... 126/92 R, 92 AC, 92 C, 126/298, 512, 540; 431/125; 239/597

[56] References Cited

U.S. PATENT DOCUMENTS

| | | | |
|---|---|---|---|
| 177,017 | 5/1976 | Saunders | 126/298 |
| D. 245,993 | 10/1977 | Anderson | D23/93 |
| D. 273,321 | 4/1984 | Cosper | D23/90.1 |
| 2,057,659 | 10/1936 | Daniel | 126/298 |
| 3,042,109 | 7/1962 | Peterson | 431/125 |
| 3,291,116 | 12/1966 | Brooks | 431/125 |
| 3,362,395 | 1/1968 | Peterson | 126/92 |
| 3,382,861 | 5/1968 | Peterson | 126/92 |
| 3,543,741 | 12/1970 | Whitehead | 126/92 |
| 3,613,660 | 10/1971 | Wilkinson | 126/298 |
| 3,696,801 | 10/1972 | Whitehead | 126/92 R |
| 3,723,046 | 3/1973 | Poling | 431/18 |
| 3,747,585 | 7/1973 | Coats | 126/92 R |
| 3,760,790 | 9/1973 | Voges et al. | 126/92 R |
| 3,805,762 | 4/1974 | Nelson | 126/4 |
| 3,817,686 | 6/1974 | Quittner | 431/125 |
| 3,842,821 | 10/1974 | Juris | 126/125 |
| 3,871,355 | 3/1975 | Henry | 126/127 |
| 4,000,732 | 1/1977 | White | 126/92 R |
| 4,061,133 | 12/1977 | Swain | 126/350 R |
| 4,306,537 | 12/1981 | Mitchell | 126/92 AC |
| 4,502,463 | 3/1985 | Gregory | 126/121 |
| 4,573,446 | 3/1986 | Rosiek et al. | 126/92 R |
| 4,573,905 | 3/1986 | Meyers | 431/125 |
| 4,582,478 | 4/1986 | Hilker | 431/125 |
| 4,602,609 | 7/1986 | Wright | 126/92 AC |
| 4,637,372 | 1/1987 | Mogol et al. | 126/127 |

*Primary Examiner*—Randall L. Green

*Attorney, Agent, or Firm*—Wolf, Greenfield & Sacks

[57] ABSTRACT

A gas burning artificial log assembly includes an artificial log set, a gas burner and andirons for support of the artificial logs. Each of the artificial logs has a front face and a different rear face and can be reversed so as to change the appearance of the artificial log set. The faces of the logs can simulate different wood types or can have a partially-burned appearance. The artificial logs are shaped to define a combustion chamber that promotes complete gas combustion and provides a realistic-appearing gas flame. The gas burner includes a burner pan and a T-shaped manifold that define a pair of adjustable-width rear gas exit slots for producing a rear flame between the logs and further define a front gas exit slot for producing a front flame. The exit slots can be adjusted in width to insure complete combustion for different gas type such as propane and natural gas. The andirons, the gas burner and the artificial logs are keyed to insure proper alignment.

9 Claims, 5 Drawing Sheets

GAS BURNING ARTIFICIAL LOG ASSEMBLY

FIELD OF THE INVENTION

This invention relates to artificial log assemblies for use in fireplaces and the like and, more particularly, to a gas burning artificial log assembly which closely simulates the appearance of burning wood logs and which provides a high degree of flexibility in its appearance.

BACKGROUND OF THE INVENTION

Artificial log assemblies which simulate the appearance of burning wood logs are well-known in the art. These assemblies typically include several artificial logs of a ceramic or other non-flammable material designed to simulate the appearance of wood logs and a gas assembly for supplying a flammable gas underneath the artificial logs. The gas is burned to produce a flame in the vicinity of the logs. The artificial log assembly can include a tank or reservoir for holding the flammable gas or can be connected by a pipe to a remote gas source. Such artificial log assemblies are usually placed in a fireplace and provide both the heat and the pleasing appearance of a wood fire, while avoiding the inconvenience and lack of cleanliness associated with the loading of wood into and removal of ashes from conventional wood burning fireplaces.

A primary objective in the design and construction of artificial log assemblies for fireplaces is to provide artificial logs that look like real logs and to provide gas flames which closely simulate the flames produced by burning wood so that an overall effect of burning wood is produced. Both the size and color of the flame and its position relative to the artificial logs are important in producing a realistic effect. Other factors include minimizing the soot and noxious gases produced by the combustion and minimizing the cost of the assembly. Artificial log assemblies have been disclosed in a number of prior art patents including U.S. Pat. Nos. 3,543,741 (Whitehead); 3,747,585 (Coats); 3,696,801 (Whitehead); 4,582,478 (Hilker); 4,637,372 (Mogol et al); 3,760,790 (Voges et al); 3,817,686 (Quittner); 3,871,355 (Henry); and Des. 245,993 (Anderson et al). A configuration for improving combustion efficiency is disclosed in U.S. Pat. No. 4,306,537 (Mitchell).

The prior art has also disclosed fireplace configurations having the flexibility to be used for different purposes. A gas burning artificial log fireplace having an assembly that rotates about a horizontal axis to conceal the artificial logs and expose a cooking unit is disclosed in U.S. Pat. No. 3,805,762 (Nelson). A double-sided fireplace which can burn wood or coal on one side and which can be rotated about a vertical axis to expose an artificial log fireplace is disclosed in U.S. Pat. No. 3,842,821 (Juris).

Prior art gas burning artificial log assemblies have had various disadvantages and drawbacks including an unrealistic appearance, excessive complexity and a lack of flexibility after installation.

It is a general object of the present invention to provide an improved gas burning artificial log assembly.

It is another object of the present invention to provide a gas burning artificial log assembly having an appearance which closely simulates the appearance of burning wood logs.

It is a further object of the present invention to provide a gas burning artificial log assembly wherein the appearance of the assembly can readily be changed.

It is yet another object of the present invention to provide a gas burning artificial log assembly which is adjustable to provide complete combustion for different gas types.

It is still another object of the present invention to provide a gas burning artificial log assembly which is simple in construction and low in cost.

SUMMARY OF THE INVENTION

According to the present invention, these and other objects and advantages are achieved in a gas burning artificial log assembly comprising a plurality of artificial logs, gas burner means for providing a gas flame in the vicinity of the artificial logs and log support means for supporting the artificial logs above the gas burner means. The artificial log assembly can be utilized in a freestanding fireplace or in a conventional wall-mounted fireplace.

According to one important aspect of the invention, the artificial logs each have two or more different faces that can readily be turned to the front of the assembly at the option of the user so as to change its appearance. The different log faces can simulate different wood types such as birch, oak or pine, and one or more of the log faces can have a partially-burned appearance. In a preferred embodiment, the artificial logs each have a front face and a rear face and are individually reversible on the support means about a vertical axis between a forward position and a reversed position so that either the front face or the rear face is visible to the user.

In a preferred embodiment, the artificial logs include a front log and a rear log supported by the support means and a top log supported by the front and rear logs. The top log is upwardly arched to define a combustion region between the front, rear and top logs. Preferably, the front and rear logs are reduced in cross-sectional area in a central portion in order to define an enlarged combustion region between them. In addition, the artificial logs are preferably tapered in the central region from relatively wide at the top to relatively narrow at the bottom in order to shape the combustion region for a realistic-appearing flame and for complete combustion. The artificial logs preferably have a cross-section in the central portion that is symmetrical about a center plane so that the adjacent combustion region has approximately the same size and shape in both the forward and reversed positions of the artificial logs.

According to another aspect of the invention, the gas burner means comprises a burner pan having a bottom plate, a burner manifold mounted on the bottom plate and means for introducing gas into the burner manifold. The burner pan and the burner manifold define between them a gas carrying conduit having an elongated rear gas exit slot aligned generally parallel to the artificial logs for producing a gas flame in the combustion region between the artificial logs and a second relatively small front gas exit slot for producing a gas flame in front of the artificial logs. The gas exit slots have an adjustable width to permit complete combustion of different gas types. Preferably, the rear slot is defined between a rib on the bottom plate of the burner pan and the front of the burner manifold. The rear slot is adjusted in width by moving the manifold relative to the rib. The front slot is preferably located above the level of the rear slot to provide a realistic flame in front of the artificial logs.

The burner manifold is preferably T-shaped so that both the front and rear gas exit slots are defined by a single cast iron manifold.

BRIEF DESCRIPTION OF THE DRAWINGS

For a better understanding of the present invention together with other and further objects, advantages and capabilities thereof, reference is made to the accompanying drawings which are incorporated herein by reference and in which.

DETAILED DESCRIPTION OF THE INVENTION

Figure 1:
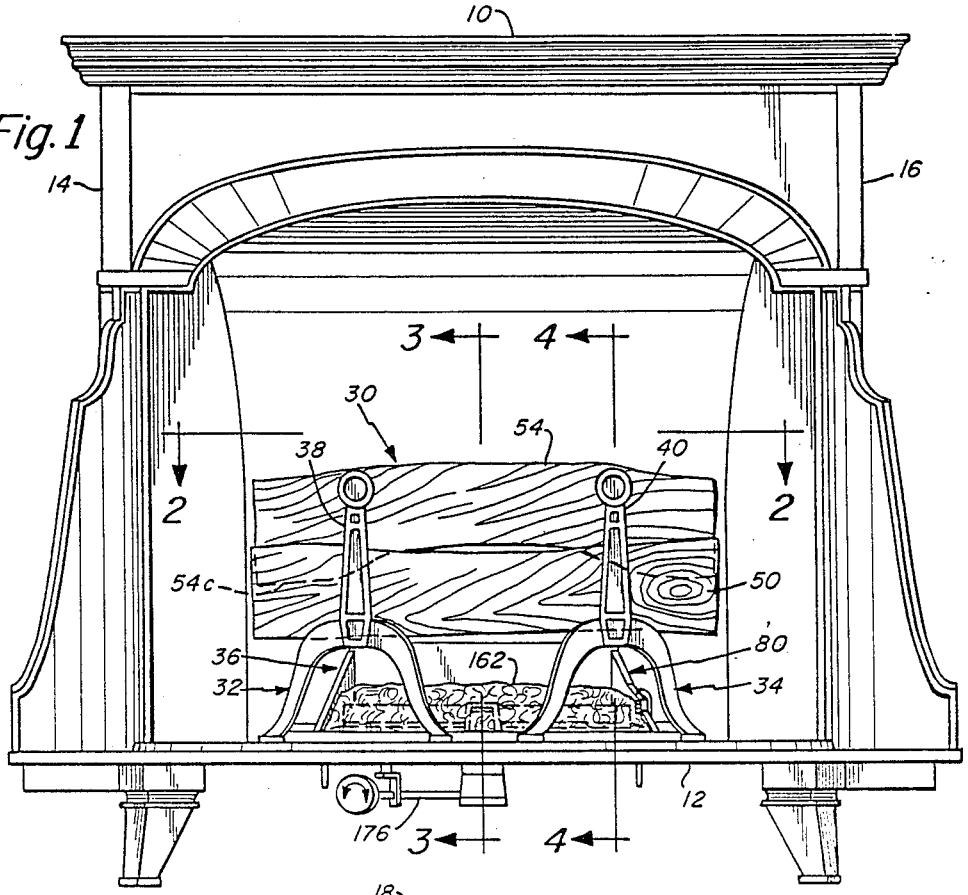
FIG. 1 is a front elevation view of a freestanding fireplace including a gas burning artificial log assembly in accordance with the present invention.
Figure 2:
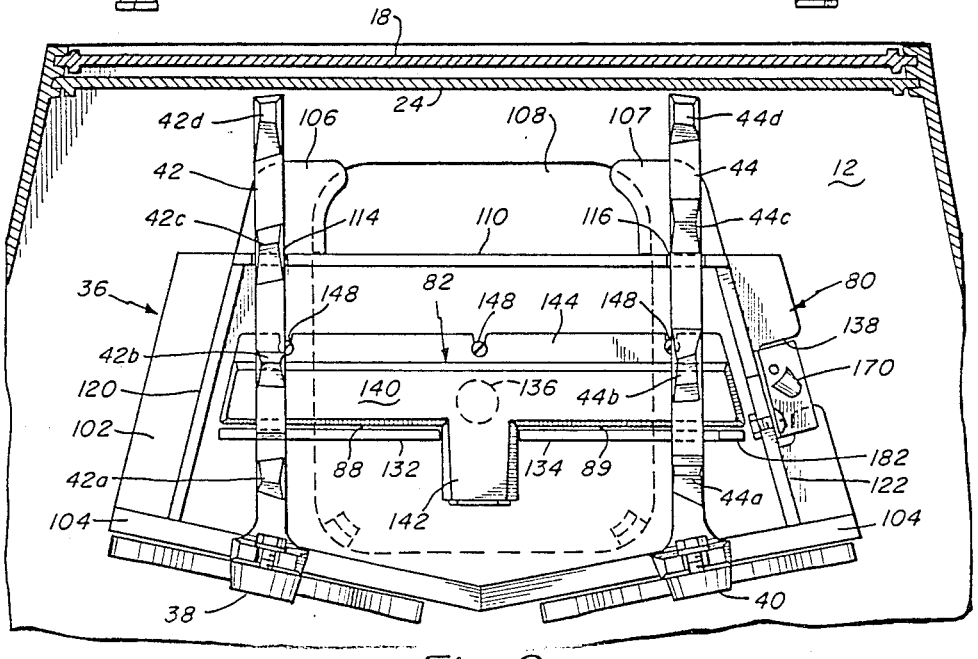
FIG. 2 is a cross-sectional plan view of the gas burning artificial log assembly with the logs removed and taken through the line 2—2 of FIG. 1.
Figure 3:
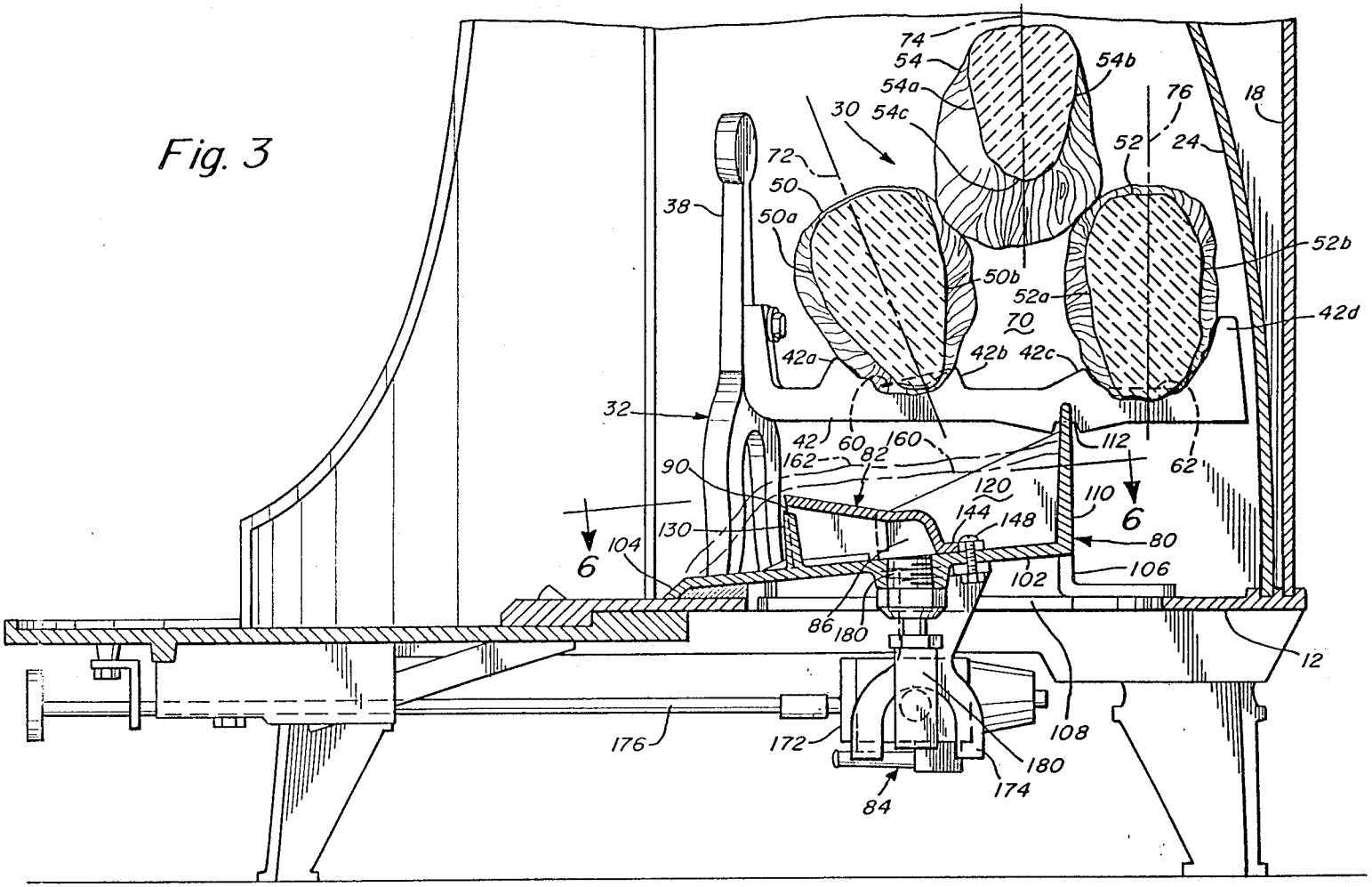
FIG. 3 is a partial cross-sectional elevation view of the fireplace and gas burning artificial log assembly taken through line 3—3 of FIG. 1.

A gas burning artificial log assembly in accordance with the present invention is illustrated in FIGS. 1–3 in a freestanding fireplace. It will be understood that the fireplace forms no part of the present invention and that the artificial log assembly can be utilized in any suitable freestanding or wall-mounted fireplace. The fireplace includes a top 10, a bottom 12, left and right side walls 14 and 16 and a back 18 which together form an enclosure for the artificial log assembly. The front can be left open as shown or can be closed by glass panels or screens (not shown). A fireback 24 is located at the rear of the enclosure and a damper (not shown) controls the flow of exhaust gases to a chimney or stovepipe.

The gas burning artificial log assembly of the invention includes an artificial log set 30, andirons 32 and 34 for supporting the artificial log set 30 and a gas burner assembly 36 positioned beneath the artificial log set 30. The andirons 32, 34 include vertical andiron members 38, 40 located at the front of the assembly and horizontal andiron dogs 42, 44 extending rearwardly from the respective andiron members 38, 40. The vertical members 38, 40 typically have an attractive appearance and support the front ends of the andiron dogs 42 and 44. The andiron dogs 42, 44 are supported at the rear by the gas burner assembly 36 as shown in FIG. 3.

The artificial log set 30 typically includes a front log 50 and a rear log 52, both of which rest on andiron dogs 42, 44, and a top log 54 that is supported by front and rear logs 50, 52 in a position above and between front log 50 and rear log 52. The artificial logs are preferably fabricated from a castable refractory material. In accordance with an important aspect of the present invention, each of the logs 50, 52, 54 includes a front face and a rear face having different appearances and is reversible about a vertical axis to forward and reversed positions. This feature permits the overall appearance of the artificial log assembly to be changed at the option of the user. Front log 50 includes front face **50*a* and rear face 50*b*; rear log 52 includes front face 52*a* and rear face 52*b*; and top top 54 includes front face 54*a* and rear face 54*b*. The different artificial log faces can simulate different wood types such as birch, oak, pine or any other desired tree type, and one or more of the artificial log faces can have a partially burned appearance to provide a more realistic simulation. Preferably, but not necessarily, all of the front faces 50*a*, 52*a*, 54*a* have one appearance such as unburned pine, while all of the rear faces 50*b*, 52*b*, 54*b*** have a second appearance such as partially-burned oak.

While the artificial logs of the present invention have been described as each having two faces, it will be understood that each of the logs can have more than two faces which can be turned to the front of the assembly in order to provide more than two different appearances. Typically, less than half of an artificial log is visible at any time.

Figure 5:
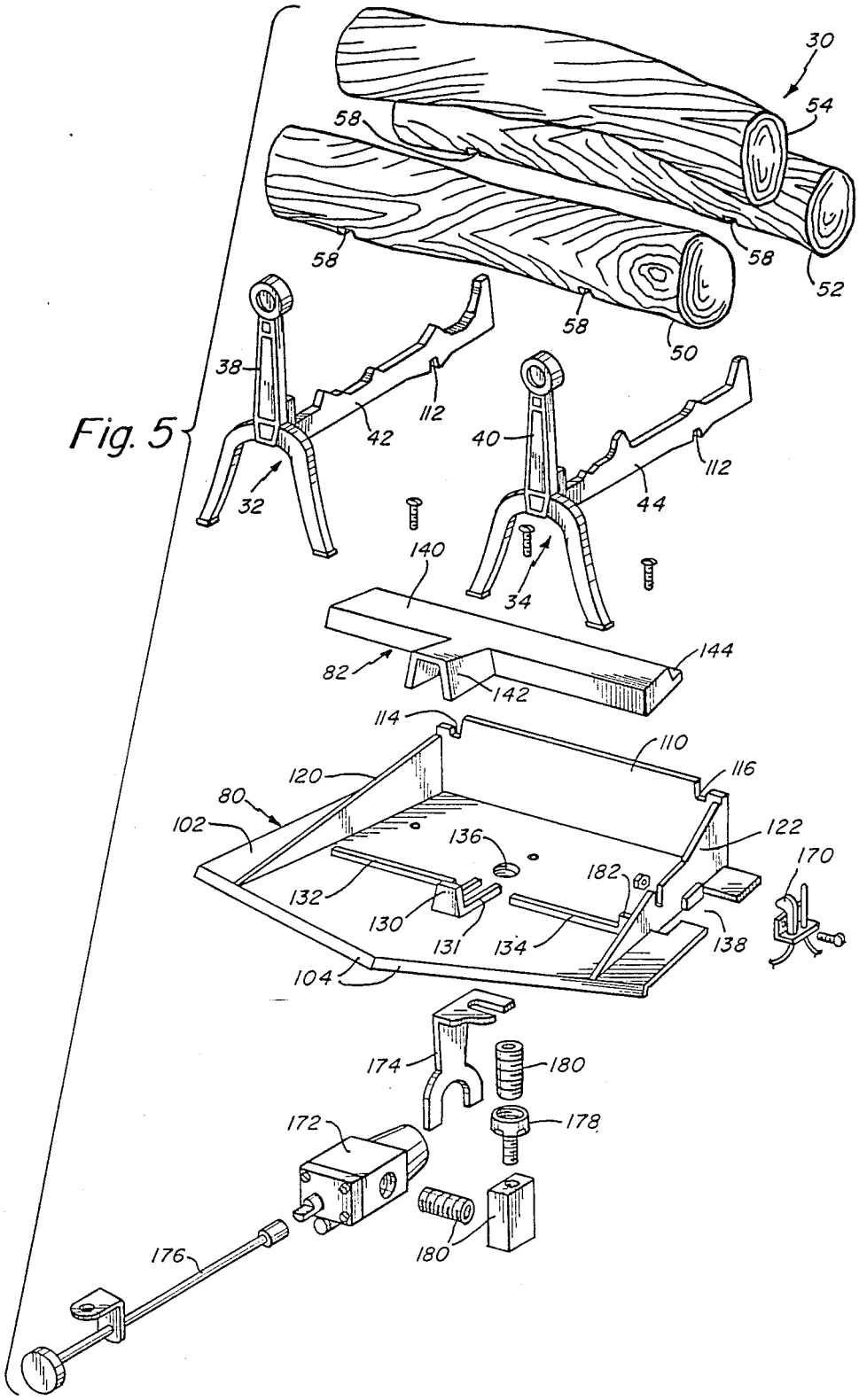
FIG. 5 is an exploded perspective view of the artificial log assembly of the present invention.

To permit the artificial logs 50, 52, 54 to be easily reversed in the assembly, they are not attached to the andiron dogs 42, 44 and are not attached to each other. To prevent misalignment of the artificial logs with the rest of the assembly, the front and rear logs 50, 52 and the andiron dogs 42 and 44 are keyed. The front and rear logs 50, 52 each include a pair of front-to-rear grooves or slots 58 (see FIG. 5). The slots 58 are spaced-apart and have sufficient width to receive the andirons dogs 42, 44. Thus, the slots 58 prevent the artificial logs from being misaligned to the left or the right along their length.

Figure 4:
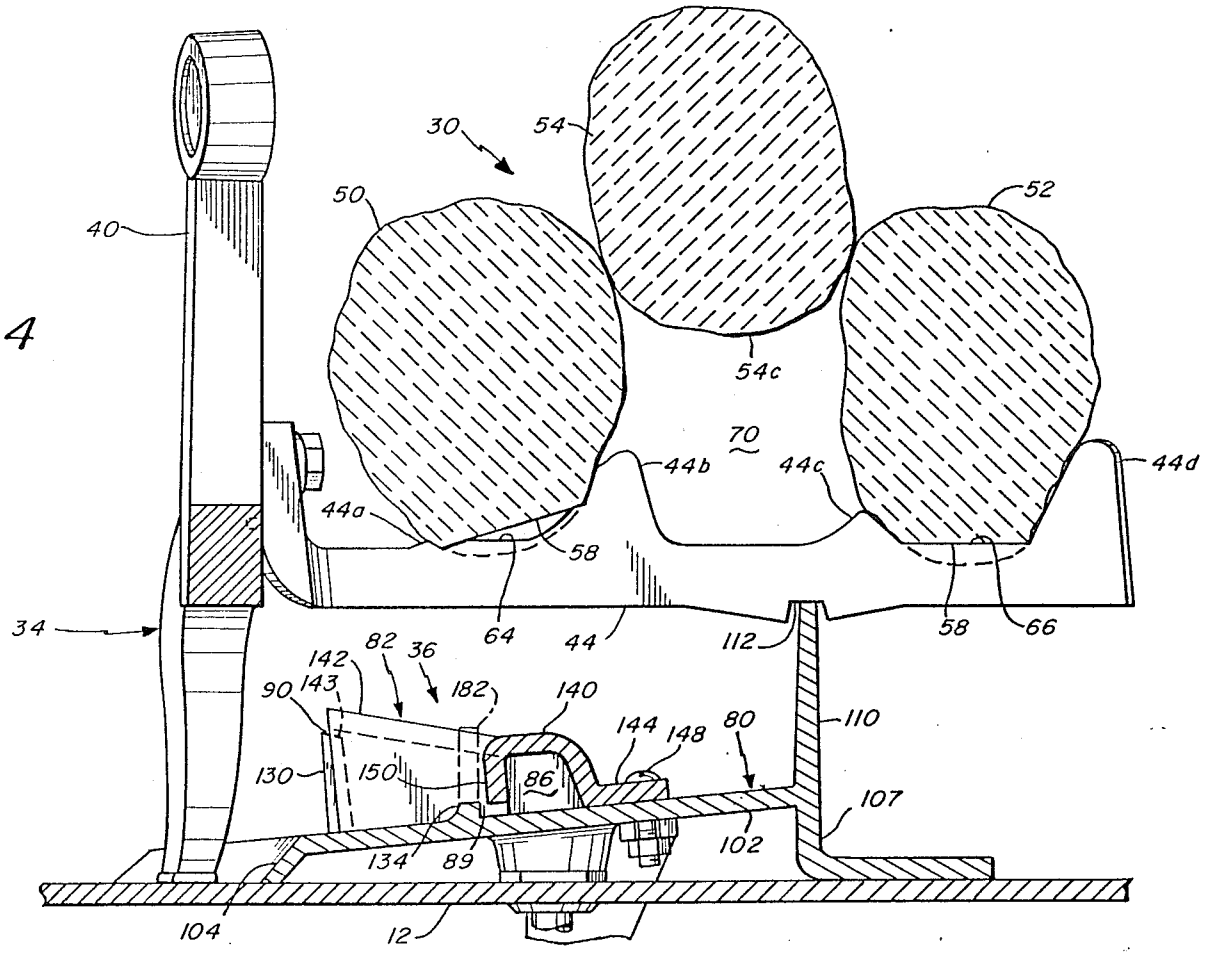
FIG. 4 is a cross-sectional elevation view of the artificial log assembly taken through line 4—4 of FIG. 1.

To insure correct front to rear alignment, the andirons dogs 42, 44 each have upward projections which define log receiving recesses between them. Left andiron dog 42, as shown in FIGS. 2 and 3, includes projections **42*a* and 42*b* which define a recess 60 for front log 50, and includes projections 42*c* and 42*d* which define a recess 62 for receiving rear log 52. Right andiron dog 44, as shown in FIGS. 2 and 4, includes projections 44*a* and 44*b* which define a recess 64 for receiving front log 50, and includes projections 44c and 44d which define a recess 66 for receiving rear log 52. As a result, the artificial logs are properly aligned in both left-to-right and front-to-rear directions in both forward and reversed positions even though the individual logs simply rest on the andiron dogs 42 and 44**.

In accordance with another aspect of the invention, the artificial logs 50, 52, 54 are preferably shaped in a specific manner to define a combustion chamber that promotes complete combustion of gas and directs gas flames in a realistic-appearing manner. Preferably, each of the logs 50, 52, 54 is tapered in cross-sectional area from relatively large at each end to relatively small in a central region. In a preferred configuration, the artificial logs are stacked as shown in FIGS. 3 and 4 with front and rear logs 52 spaced apart and top log 54 supported by both front and rear logs 50 and 52. In this configuration, a combustion chamber 70 is defined between the logs. The tapering of the logs 50, 52, 54 from the ends to the central region produces an enlargement of the combustion chamber 70 cross-sectional area in the central region. The combustion chamber 70 is correspondingly tapered to a smaller cross-sectional area toward each end of the artificial logs 50, 52, 54. As described hereinafter, the gas burner assembly 36 is configured to direct a gas flame into the combustion chamber 70, and the enlargement of combustion chamber 70 in its central portion has been found to promote more complete gas combustion and less emission of noxious gases. In addition, the tapering of the artificial logs 50, 52, 54 in the central region creates gaps between them through which the gas flame can pass, particularly between front log 50 and top log 54.

According to another feature of the artificial log set 30, the top log 54 has a lower surface 54*c* as shown in FIG. 1 that is upwardly arched in the central region. The arched surface 54*c* provides the combustion chamber 70 with a further enlarged cross-sectional area in the central region, while the ends of the arched surface 54*c* reduce the cross-sectional area of combustion chamber 70 near the ends of the artificial logs. This shaping of top log 54 further enhances the above-described advantages of a combustion chamber 70 having an enlarged central region.

According to yet another feature of the artificial log set 30, the central portions of front log 50 and top log 54 have cross-sectional areas that are tapered from wider at the top to narrower at the bottom, as shown in FIG. 3. The tapering of the log cross-sections from top to bottom in the central region further shapes the combustion chamber 70 and enhances the realistic appearance of the gas flame associated with the artificial log set 30. The rear log 52 can also have a cross-sectional area in the central region which is tapered from top to bottom. However, in a preferred embodiment, the rear log 52 is not so tapered.

Preferably, each of the logs 50, 52, 54 has a shape, particularly in the central region, that is more or less symmetrical about central planes 72, 74, 76, respectively, through each of the logs so that the size and shape of combustion chamber 70 remains more or less the same whether the artificial logs are placed in the forward position or the reversed position. I is preferred that the axis 72 of front log 50 be tipped forward from vertical so that rear face 50*b* is approximately vertical in combustion chamber 70 and front face 50*a* is tipped forward. This orientation has been found to further promote complete combustion and a realistic-appearing gas flame.

The artificial logs 50, 52, 54 have been described herein as having specific shapes to define a combustion chamber 70 having a predetermined shape. It will be understood that artificial logs having two or more faces that can selectably be oriented toward the front, i.e. reversible artificial logs, and having any desired shape, i.e. cylindrical, are included within the scope of the present invention.

The gas burner assembly 36 includes a burner pan 80 mounted to the bottom 12 of the fireplace, a generally T-shaped burner manifold 82 mounted to burner pan 80, and a gas supply and control unit 84. The burner pan 80 and the burner manifold 82 are preferably fabricated of cast iron. The burner pan 80 and the burner manifold 82 define between them a conduit 86 for carrying gas from the supply and control unit 84 to a pair of elongated rear exit slots 88 and 89 and to a front exit slot 90. Rear exit slots 88, 89 supply gas for a rear flame that extends into and through combustion region 70 between the artificial logs 50, 52 and 54. Front exit slot 90 supplies gas for a front flame that extends upwardly in front of front log 50.

The burner pan 80 includes a generally flat bottom plate 102 having a down-turned lip 104 on its front edge that raises the bottom plate 102 slightly above the surface on which it rests. The bottom plate 102 is further provided with rear support legs 106, 107 that raise the rear of the bottom plate 102 so that it is inclined to the rear at an angle with respect to bottom 12. In a preferred embodiment of the invention, the bottom 12 of the freestanding stove includes an air inlet 108 that carries combustion air into the enclosure. The raised and angled configuration of the bottom plate 102 permits air to flow around the sides and rear of the bottom plate 102 into the combustion region 70.

The burner pan 80 is further provided with an upstanding back wall 110 that supports andiron dogs 42 and 44. In a preferred embodiment, the andiron dogs 42, 44 include notches 112 for front-to-rear alignment on back wall 110, and back wall 110 includes notches 114, 116 for side-to-side alignment of andiron dogs 42, 44, respectively. The notches 112, 114, 116 insure that the artificial log set 30 is properly aligned with the gas burner assembly 36 without a rigid interconnection between these elements. The burner pan 80 further includes side walls 120 and 122 that extend upwardly from bottom plate 102 and taper in height from highest at the rear to approximately zero height at the front.

Burner pan 80 further includes an upwardly-extending projection 130 approximately centered from left to right on bottom plate 102 that in combination with manifold 82 defines front exit slot 90. Ribs 131 extend rearwardly along bottom plate 102 from opposite sides of projection 130. A pair of ribs 132, 134 extend laterally on bottom plate 102 generally parallel to artificial logs 50, 52, 54. The ribs 132, 134 in combination with burner manifold 82 define rear exit slots 88, 89. An opening 136 in bottom plate 102 provides an inlet for gas into conduit 86, and a cutout 138 in the right side of the bottom plate 102 is used for mounting of a gas pilot.

As mentioned previously, the burner manifold 82 is generally T-shaped and includes a top manifold portion 140 extending generally parallel to the artificial log set 30 and a base manifold portion 142 extending forwardly of top portion 140 at the center thereof. In cross-section, both the top manifold portion 140 and the base manifold portion 142 are roughly in the form of an inverted U. The top portion 140 includes a rearwardly-extending flange 144 provided with slots 146 for adjustable mounting of manifold 82 to bottom plate 102. Mounting bolts 148 pass through slots 146 and maintain manifold 82 in a fixed position. When adjustment is desired, bolts 148 are loosened and manifold 82 is moved forwardly or rearwardly as necessary.

Figure 6:
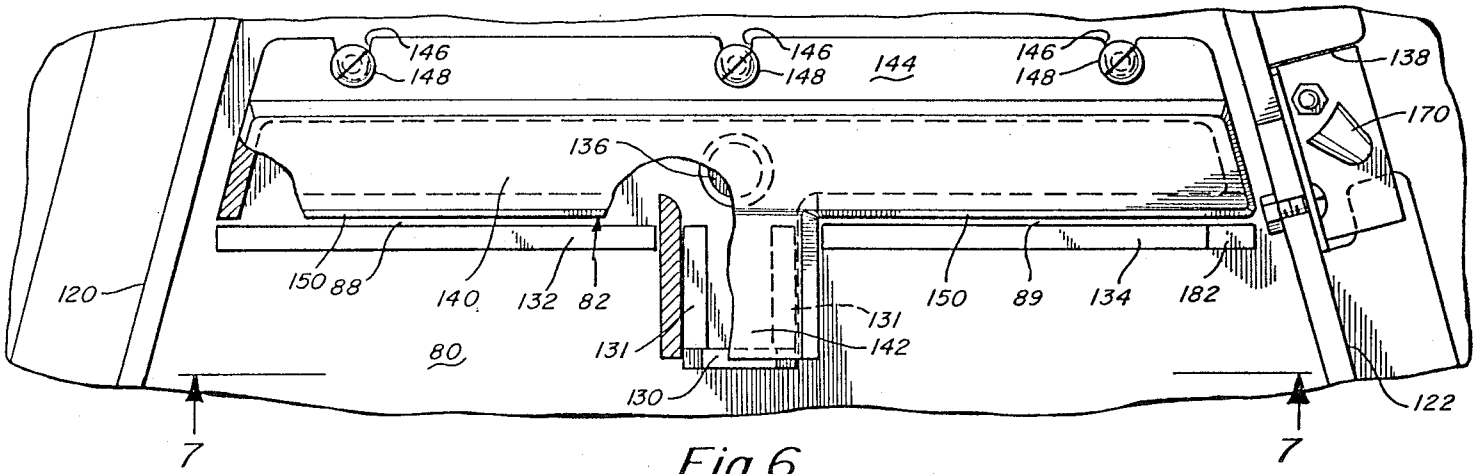
FIG. 6 is a fragmentary plan view of the gas burner manifold and burner pan taken along the line 6—6 of FIG. 3.
Figure 7:
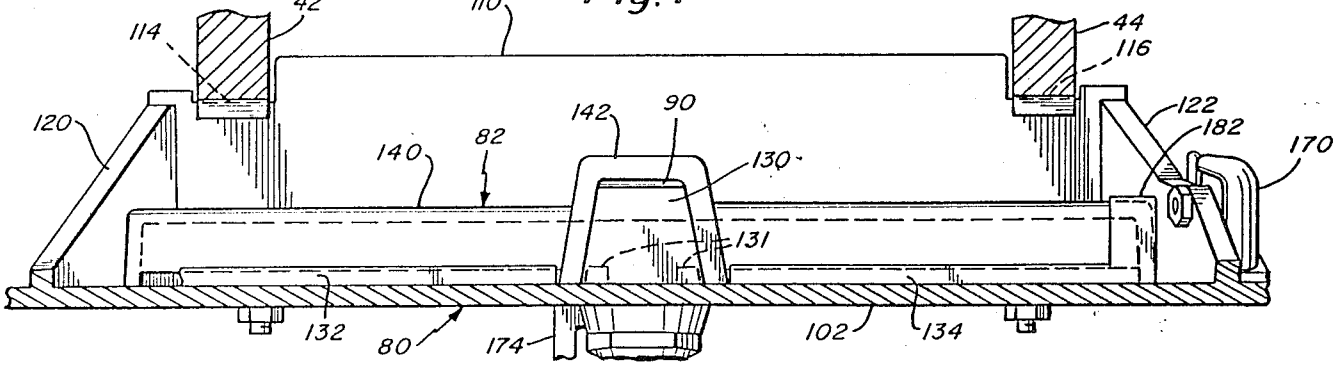
FIG. 7 is a cross-sectional view of the gas burner manifold and burner pan taken through the line 7—7 of FIG. 6.

The front 150 of top manifold portion 140 is spaced from bottom plate 102, as best shown in FIG. 4 and is spaced slightly to the rear of ribs 132, 134, as best shown in FIG. 6. Front 150 and ribs 132, 134 define between them rear exit slots 88, 89, respectively. As noted above, burner manifold 82 can be adjusted forwardly or rearwardly to vary the width of exit slots 88 and 89. Such adjustability permits slot width variations due to manufacturing tolerances to be eliminated. In addition, the width of rear exit slots 88 and 89 can be adjusted for use of different gases, such as natural gas or propane, while maintaining complete and efficient combustion for any gas type. Preferably, the slots 88 and 89 have a width of 0.060-inch for propane and 0.130-inch for natural gas. The rear slots 88 and 89 are preferably set to the desired width with a pin gauge or other suitable gauge.

The base manifold portion 142 is in the form of an inverted U which extends forwardly to projection 130. Front exit slot 90 is defined between the top of projection 130 and the bottom inside edge of manifold portion 142. The top 143 of projection 130 is preferably beveled downwardly to the rear at an angle greater than the angle of base manifold portion 142 so that the width of front exit slot 90 is adjustable when manifold 82 is moved forwardly or rearwardly. Ribs 131 position the burner manifold 82 and assist in sealing the sides of base manifold portion 142 against gas leakage in undesired areas. Preferably, front exit slot 90 is raised about one inch above rear exit slots 88 and 89 and has a width of about 0.030 inch for propane and a width of about 0.060 inch for natural gas.

In operation, gas is supplied through opening 136 at the intersection of top and base manifold portions 140, 142. The gas flows through conduit 86 and is supplied through rear exit slots 88 and 89 and through front exit slot 90. Preferably, the burner pan 80 is filled with vermiculite 160 to diffuse and distribute the gas throughout the pan. In the front section of the burner pan, the vermiculite is covered with mineral wool 162 to simulate glowing embers.

The gas supply and control unit 84 is of conventional configuration and includes a safety pilot burner 170 mounted at the right end of the burner manifold 82, a safety pilot valve 172 mounted to the underside of bottom plate 102 by a valve support bracket 174, an adjustment knob and control rod 176 coupled to valve 172, an air mixer 178 and fittings 180 connecting valve 172 to opening 136 in bottom plate 102. Gas is supplied from an appropriate source to valve 172. A projection 182 from bottom plate 102 deflects a portion of the gas passing through slot 89 in the direction of pilot burner 170 to insure reliable ignition.

While there has been shown and described what is at present considered the preferred embodiments of the present invention, it will be obvious to those skilled in the art that various changes and modifications may be made therein without departing from the scope of the invention as defined by the appended claims.

What is claimed is:

1. A gas burning artificial log assembly comprising:
a plurality of artificial logs;
gas burner means for providing a gas flame in the vicinity of said artificial logs, said gas burner means including
a burner pan having a bottom plate,
a burner manifold mounted on said bottom plate, said burner pan and said burner manifold defining a gas-carrying conduit including a rear gas exit slot aligned generally parallel to said artificial logs for producing a gas flame between said artificial logs and a front gas exit slot forward of said artificial logs for producing a gas flame in front of said artificial logs, and
means for introducing gas into said gas-carrying conduit; and
log support means for supporting said artificial logs above said gas burner means.

2. An artificial log assembly as defined in claim 1 wherein said burner manifold includes a lateral portion parallel to said logs and a centrally-located forward portion perpendicular to said lateral portion.

3. An artificial log assembly as defined in claim 2 wherein said burner pan includes at least one raised rib on said bottom plate, wherein said raised rib and said burner manifold define between them said rear gas exit slot, and wherein said burner manifold is movable relative to said raised rib so as to vary the width of said rear gas exit slot.

4. An artificial log assembly as defined in claim 2 wherein said forward portion of said burner manifold includes means defining said front gas exit slot above the level of said rear gas exit slot.

5. An artificial log assembly as defined in claim 1 wherein said support means includes a pair of spaced-apart andiron dogs for supporting said artificial logs and wherein said burner pan includes a generally upright rear wall for supporting said andiron dogs.

6. An artificial log assembly as defined in claim 1 including means for raising said burner pan above a support surface so that combustion air introduced below said bottom plate flows around the sides and rear thereof toward said artificial logs.

7. A gas burning artificial log assembly comprising:
a plurality of artificial logs,
gas burner means for providing a gas flame in the vicinity of said artificial logs, said gas burner means including means defining a gas-carrying conduit having an adjustable-width, elongated gas exit slot parallel to said artificial logs; and
log support means for supporting said artificial logs above said gas burner means.

8. An artificial log assembly as defined in claim 7 wherein said artificial logs include at least a front log and a rear log and define between them a combustion region where at least a portion of said gas flame is located.

9. An artificial log assembly as defined in claim 8 wherein said artificial logs each have a front face and a rear face and are individually reversible on said support means between a forward position and a reversed position so that the front face or the rear face is visible.

* * * * *